US005951186A

United States Patent [19]

Lhuisset

[11] Patent Number: 5,951,186

[45] Date of Patent: Sep. 14, 1999

[54] APPLICATOR APPARATUS FOR A MORE OR LESS VISCOUS LIQUID PRODUCT SUCH AS NAIL VARNISH

[75] Inventor: François Lhuisset, Montgeron, France

[73] Assignee: LVMH Recherche, Nanterre, France

[21] Appl. No.: 09/029,984

[22] PCT Filed: Sep. 13, 1996

[86] PCT No.: PCT/FR96/01427

§ 371 Date: Jun. 9, 1998

§ 102(e) Date: Jun. 9, 1998

[87] PCT Pub. No.: WO97/09900

PCT Pub. Date: Mar. 20, 1997

[30] Foreign Application Priority Data

Sep. 15, 1995 [FR] France ..... 95 10866

[51] Int. Cl.[6] ..... A46B 11/04

[52] U.S. Cl. ..... 401/100; 401/101; 401/102

[58] Field of Search ..... 401/100, 102, 401/115, 274, 101

[56] References Cited

U.S. PATENT DOCUMENTS

| | | | |
|---|---|---|---|
| 2,837,691 | 8/1958 | Edelstone et al. | 401/102 |
| 2,866,993 | 1/1959 | Edelstone | 401/100 |
| 2,944,274 | 7/1960 | Hopkins | 401/102 |
| 2,978,723 | 4/1961 | Hopkins | 401/100 |
| 4,773,785 | 9/1988 | Katz | 401/274 X |
| 5,131,774 | 7/1992 | Katz | 401/101 X |

FOREIGN PATENT DOCUMENTS

| | | | |
|---|---|---|---|
| 2660842 | 10/1991 | France | 401/100 |
| 3536332 | 4/1987 | Germany . | |
| WO 9013234 | 11/1990 | WIPO . | |

*Primary Examiner*—Henry J. Recla
*Assistant Examiner*—Kathleen J. Prunner
*Attorney, Agent, or Firm*—Leydig, Voit & Mayer, Ltd.

[57] ABSTRACT

An applicator apparatus for a more or less viscous liquid product such as nail varnish has a body enclosing a tank provided with a small brush which is associated with a first magnetic element inside of the tank and cooperating with a second magnetic element accommodated in sliding relationship within the body outside of the tank. The tank itself forms a push-button movably mounted axially within the body against the force of a spring arranged between the tank and the second magnetic element in order that in the position of the tank pushed into the body, the brush penetrates into the tank and that in a released portion of the tank within the body, the brush is moved out of the tank.

8 Claims, 3 Drawing Sheets

10
20
11
1
4
29
13
31
27
32
26
28a
12
30
R
28
F
14
25
24
23

APPLICATOR APPARATUS FOR A MORE OR LESS VISCOUS LIQUID PRODUCT SUCH AS NAIL VARNISH

The present invention has as its subject an applicator apparatus for a more or less viscous liquid product such as nail varnish.

One already knows apparatus of the hereabove kind comprising a body enclosing a tank provided with a small brush with which is associated a first magnetic element inside of the tank and capable of co-operating with a second magnetic element which is accommodated in sliding relationship in the body outside of the tank.

These apparatus however were generally of a complicated mechanical concept, i.e. comprised a relatively substantial number of parts and therefore were expensive.

Moreover the handling of the prior apparatus notably departs from that of the instruments currently used such as those for the graphic arts.

Therefore, the present invention has as its object to remedy in particular these inconveniences by proposing an applicator apparatus with a very simple structure, not very expensive and the manipulation and the handling of which are very easy and in a way instinctive for the users.

For that purpose the invention has as its subject an applicator apparatus for a more or less viscous liquid product such as nail varnish for example, of the type comprising a body enclosing a tank provided with a small brush or the like with which is associated a first magnetic element inside of the tank and capable of co-operating with a second magnetic element accommodated in sliding relationship in the said body outside of the tank, characterized in that the said tank itself forms a push-button movably mounted axially in the said body against the force of a spring arranged between the said tank and the second magnetic element in order that in the position of the tank pushed into the body, the small brush penetrates into the tank and that in the released position of the tank within the body, the small brush is moved out of the tank.

According to another characteristic of this apparatus, the aforesaid tank is retained in the rest or released position in the body by cooperating shoulders, studs or the like provided in the body and on the tank, respectively.

According to one particular embodiment, the aforesaid tank forming a push-button constitutes a removable cartridge extractable from the body.

In this case, the body comprises an inner shoulder onto which abuts a washer or the like upon which bears, on one side, the aforesaid spring and, on the other side, the aforesaid tank.

One should further specify that in this case here again, one provides a second spring accommodated in the tank, permanently urging the small brush to the position moved out of the tank and the returning force of which is lower than the magnetic returning forces generated by the co-operation of both aforesaid magnetic elements.

Further characteristics and advantages of the invention will appear better in the detailed description which follows and refers to the attached drawings given by way of example only and in which:

FIG. 1 diagrammatically illustrates in axial section an exemplary embodiment of an applicator apparatus according to the invention and shown in the position ready for use;

Figures 1, 2, 3:
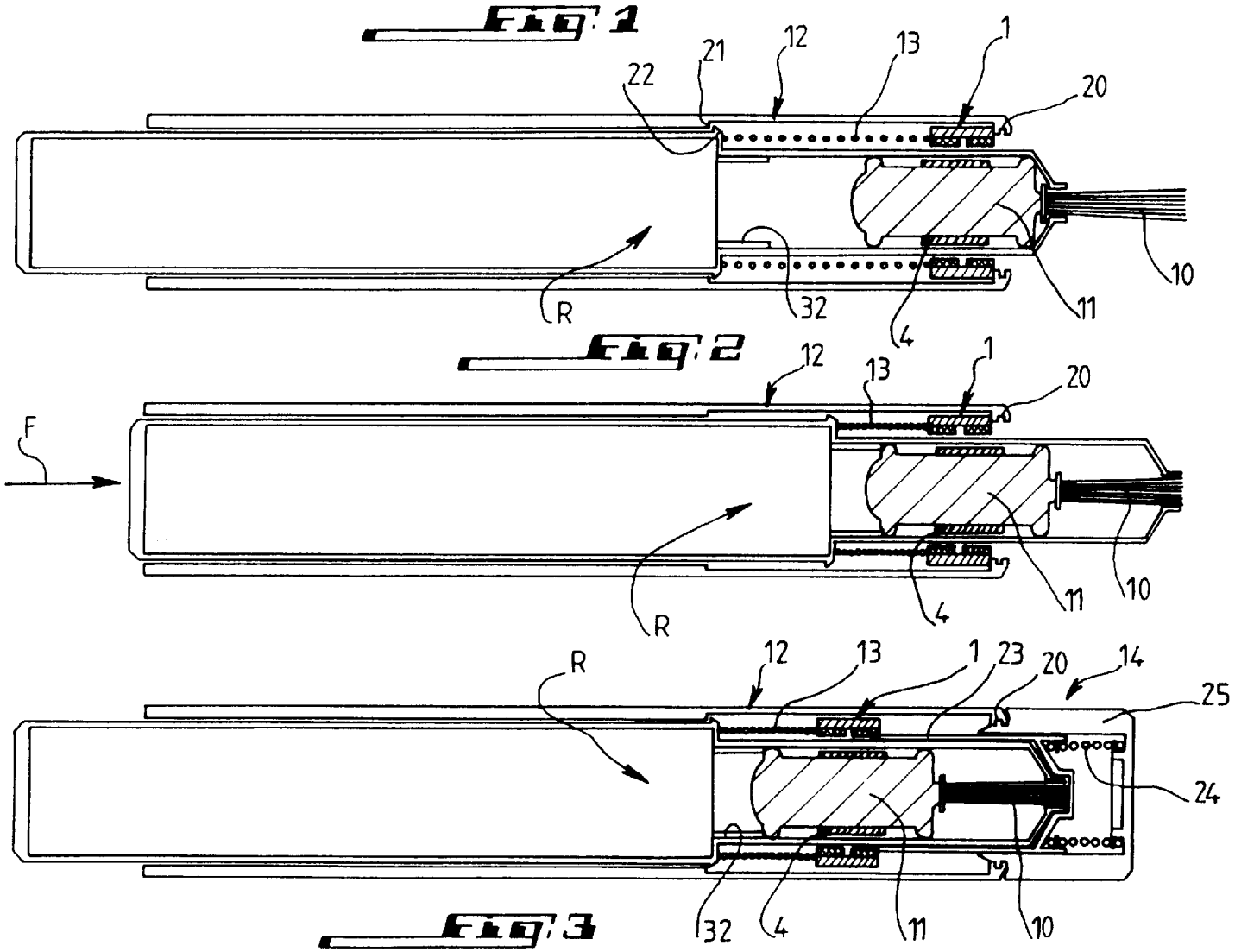
FIG. 2 is a view similar to FIG. 1, but showing the apparatus in the position of the tank pushed into the body.
FIG. 3 is a view similar to FIG. 1 but showing the apparatus closed by a stopper cap.

According to the exemplary embodiment shown in FIGS. 1 to 3, an applicator apparatus for nail varnish, for example, according to this invention essentially comprises a small brush 10 carried by a support 11 which is made fast to a first magnetic element 4 and is accommodated in sliding relationship within a tank R containing the product to be applied.

This tank R is mounted in sliding relationship within a body 12 and is acted upon by a spring 13 which acts on one side upon the said tank and on the other side upon a second magnetic element 1 accommodated in sliding relationship within the body 12 outside of the tank R. According to the exemplary embodiment shown in FIGS. 1 to 3, the second magnetic element 1 is retained by a flange 20 provided at the end of the body 12.

More precisely and as shown in the figures, the body 12 comprises an inner shoulder 21 capable of co-operating with an annular shoulder 22 provided on the tank R. One could perfectly use other suitable means other than the shoulders without leaving the scope of the invention.

Thus, as shown in FIG. 1 and according to one essential characteristic of this invention, the tank R forms a push-button which in the rest or released position will come in abutment with its shoulder 22 upon the shoulder 21 of the body 12 and this under the effect of the compression force of the spring 13.

Otherwise said, in the rest position illustrated by FIG. 1, the small brush 10 will be in the position moved out of the tank R, i.e. ready for use.

If, as shown in FIG. 2, one effects a thrust upon the bottom of the tank R as physically shown by the arrow F and against the force of the spring 13, one will effect the retraction of the small brush 10 into the said tank in view of the holding in place of the support 11 of the small brush 10 substantially in front of the second magnetic element 1 in view of the co-operation of the magnetic elements 1 and 4. This means that the small brush 10 could be impregnated with the product contained in the tank.

If after this operation one releases the thrust upon the bottom of the tank R, the latter will resume the position visible in FIG. 1, i.e. the position ready for use, the backward motion of the tank R being stopped by the co-operation of the shoulders 21 and 22.

When one no longer wants to use the apparatus, one may close it with a stopper cap such as 14 shown in FIG. 3. One sees that the stopper cap 14 causes with its portion 23, the retraction of the second magnetic element 1 against the force of the spring 13, thereby also causing the retraction of the small brush 10 into the tank R owing to the co-operation of both magnetic elements 1 and 4. Thus the small brush may not dry since it will remain soaked with the product contained in the tank or vapors of this product.

One should further note here that the stopper cap 14 comprises inside a spring 24 connecting the portion 23 to the bottom 25 of the stopper cap 14, the said portion 23 and the said bottom 25 being relatively movable through sliding, thereby, as one understands it, permitting a good closure of the apparatus even if the stopper cap 14 is not completely screwed onto the body 12.

One has therefore provided an apparatus with a particularly simple mechanical design and the tank R of which itself advantageously forms a push-button, i.e. comprises the two following functions, namely a function of filling with the product and a function of operating the apparatus, this operating function being advantageously akin to that of the apparatus usually used for writing, drawing, etc.

In the embodiment illustrated by FIGS. 4 to 7 where identical reference characters have been used for designating the common elements, the tank R with the elements it contains, namely essentially the support 11 of the small brush 10, here forms a cartridge which may be extracted from the body 12 and be easily replaced with another cartridge.

One has shown at 26 a shoulder provided inside of the body 12 of the apparatus and at 27 a washer capable of abutting upon this shoulder under the effect of the compression of the spring 13 arranged between the said shoulder and the second magnetic element 1, the spring 13 permanently urging the washer 27 into abutment against the shoulder 26.

Figures 4, 5, 6:
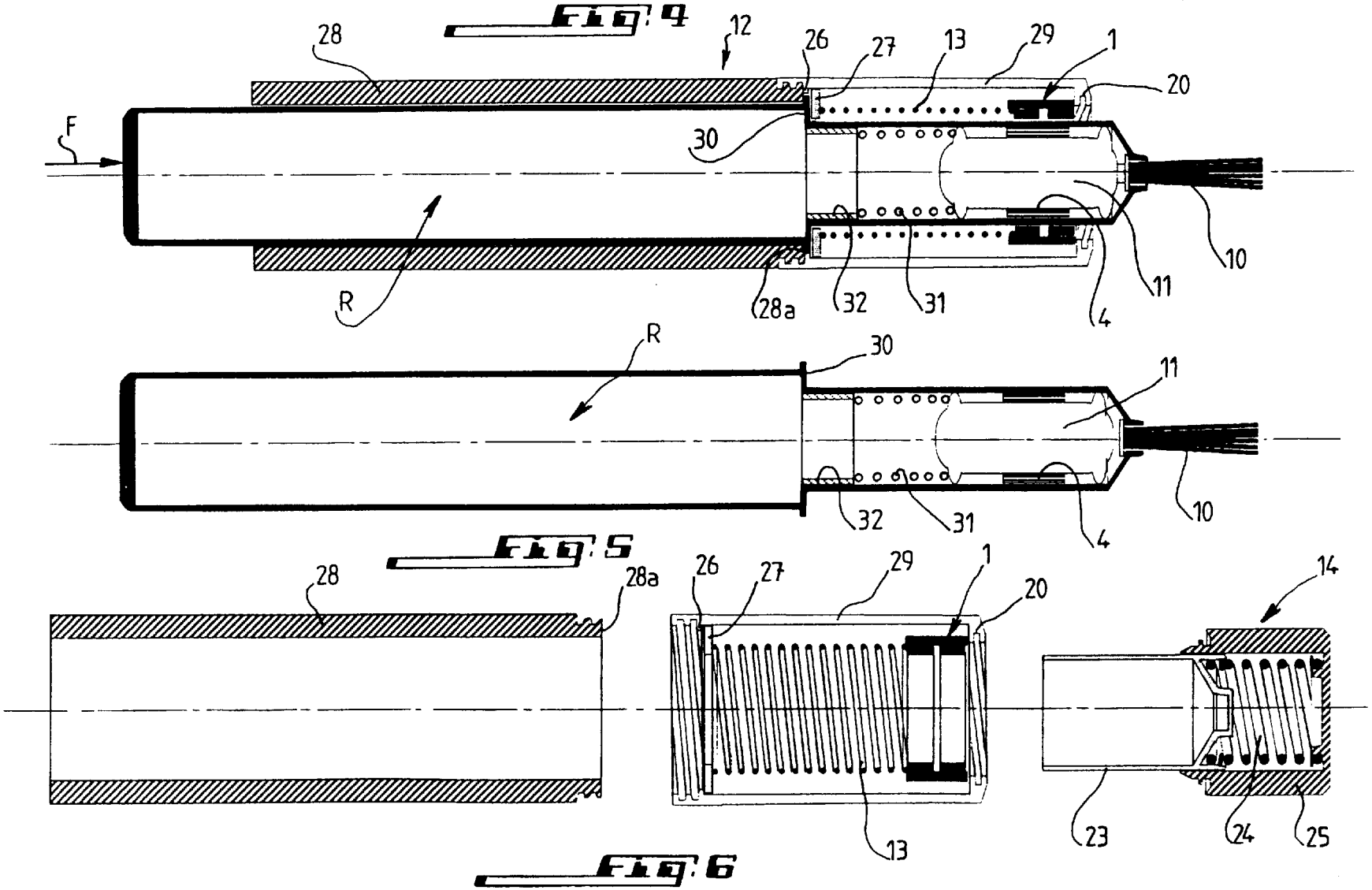
FIG. 4 illustrates in axial section another embodiment of an applicator apparatus according to this invention and shown in the position of use.
FIG. 5 is a view in axial section of the portion forming a tank extractable from the body of the apparatus with the elements it contains.
FIG. 6 is a view in axial section of the body of the disassembled apparatus as well as of the stopper cap which may close the body.

As one sees it better in FIG. 6, the body 12 consists of a rear portion 28 forming in a way a sleeve and which may be screwed onto a forward portion 29 containing the washer 27, the shoulder 26, the second magnetic element 1 and the spring 13 interposed between the washer and the magnetic element.

According to a preferred exemplary embodiment, the tank R forming a removable cartridge comprises an annular shoulder 30 capable of becoming interposed between the rear portion 28 of the body 12 and the washer 27. Therefore, the shoulder 30 interposes itself between the end 28*a* of the rear portion 28 and the washer 27.

Although not compulsory, one may provide a spring 31 within the tank R and permanently urging the small brush 10 to the position moved out of the tank R.

One should however note here that the spring 31 is bearing on one side upon the support 11 of the small brush 10 and on the other side upon a ring or the like 32 made inside fast to the tank R, this ring 32 being also visible on the embodiment of FIGS. 1 to 3 and directly serving as a stop for the support 11 of the small brush 10 when the latter is in the position retracted into the tank R.

Reverting to FIGS. 4 to 7, one sees that in the position of use, (FIG. 4), the washer 27 is in the position bearing upon the stop 26, it being understood that the tank R is retained by its shoulder 30 against the washer 27 and one end 28*a* of the rear portion 28 of the tank R.

If one exerts a thrust upon the bottom of the tank in the direction of the arrow F, the said tank with its annular shoulder 30 will push the washer 27 against the compression force of the spring 13, and the support 11 of the small brush 10 will become retracted into the tank exactly as shown in FIG. 2 and in view of the co-operation of the magnetic elements 1 and 4.

By releasing the pressure upon the bottom of the tank R which here again itself constitutes a push-button, one finds oneself again in the position of FIG. 4, i.e. the position ready for use.

Contrary to the embodiment of FIGS. 1 to 3 where the tank R is mounted to be captive and non-removable within the body 12, according to the embodiment of FIGS. 4 to 7, the tank R visible in FIG. 5 may be extracted from the body 12 for being replaced with another tank R containing a different product for example.

To carry out this extraction, it suffices to unscrew the rear portion 28 of the body 12, so that the tank R is freed and may be withdrawn from the said body 12 consisting of the rear portion 28 and of the forward portion 29.

Figure 7:
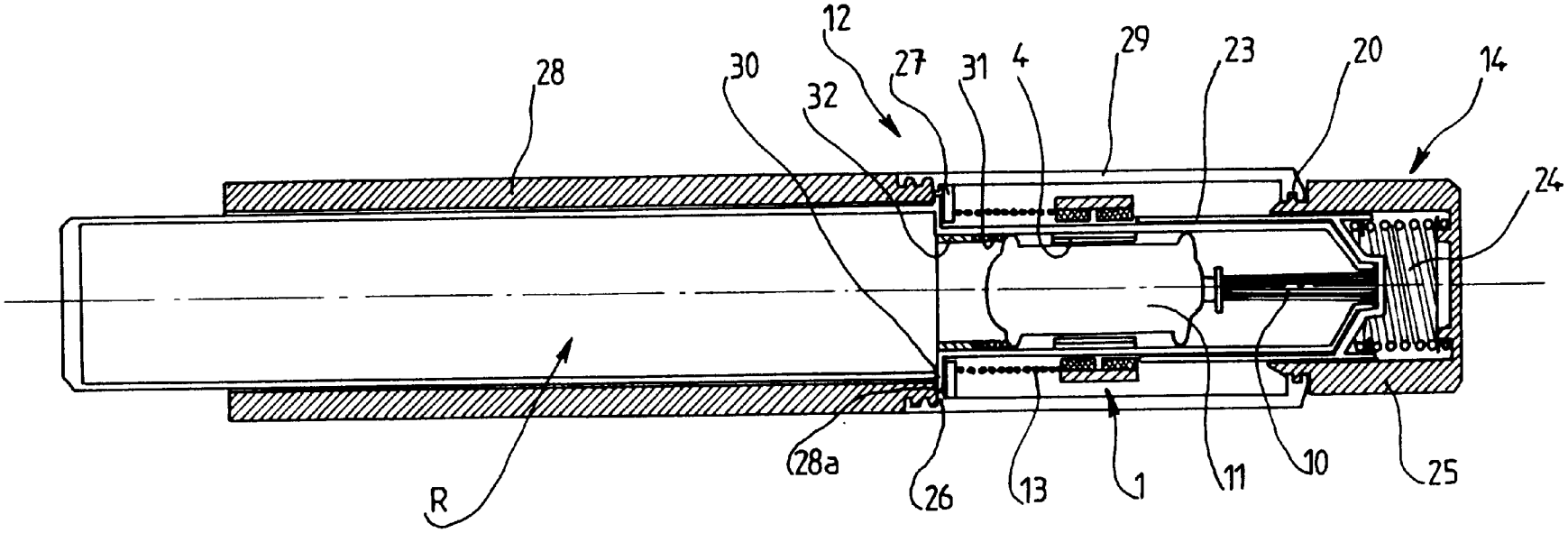
FIG. 7 is a view similar to FIG. 4 but showing the apparatus closed by the said stopper cap.

As with the foregoing embodiment and shown in FIG. 7, the applicator apparatus may be closed by a stopper cap such as 14.

One will again note here that the spring 31 provides a returning force which should be lower than the magnetic returning forces generated by the co-operation of both magnetic elements 1 and 4.

Thus the presence of the spring 31 removes the risk of leaks of the product contained within the tank R when the latter constitutes a cartridge located outside of the body 12 and capable of assuming various positions which may promote the leaks.

One has therefore provided according to the invention an applicator apparatus of nail varnish or even of other more or less viscous products, which is of a very simple structural design and which is particularly convenient and easy to use due to the fact that the tank itself allows the handling and the operation of the apparatus.

The invention is of course not at all limited to the embodiments described and illustrated which have been given by way of example only.

On the contrary, the invention comprises all the technical equivalents of the means described as well as their combinations if the latter come within the scope of the claims which follow.

I claim:

1. An applicator apparatus for a more or less viscous product comprising a body (12) enclosing a tank (R) containing the product and provided with a small brush (10) with which is associated a first magnetic element (4) inside of the tank (R) and capable of co-operating with a second magnetic element (1) accommodated in sliding relationship within the said body (12) outside of the tank, wherein the said tank (R) itself forms a push-button movably mounted axially within the body (12) against the force of a spring (13) arranged between the said tank (R) and the second magnetic element (1) in order that in a position of the tank (R) pushed into the body (12), the small brush (10) penetrates into the tank (R) and that in a released position of the tank (R) in the body (12), the small brush (10) is in a position moved out of the tank (R).

2. An apparatus according to claim 1, wherein the aforesaid tank (R) is retained in the released position in the body (12) by co-operating shoulders or studs (21,22) provided in the body (12) and on the tank (R), respectively.

3. An apparatus according to claim 1, wherein the aforesaid tank (R) forms a removable cartridge extractable from the body (12).

4. An apparatus according to claim 3, wherein the aforesaid body (12) comprises an inner shoulder (26) onto which abuts a washer (27) upon which bears on one side the aforesaid spring (13) and on the other side the aforesaid tank (R).

5. An applicator apparatus according to claim 3 or 4, including a second spring (31) permanently urging the small brush (10) to the position moved out of the tank, the returning force of which is lower than the magnetic returning forces generated by the co-operation of both aforesaid magnetic elements (1,4).

6. An apparatus according to claim 4, wherein the body (12) comprises a sleeve-shaped rear portion (28) which is screwed into a forward portion (29) receiving the second magnetic element (1) and which retains with one end (28*a*) the tank (R) within the said body.

7. An apparatus according to claim 5, wherein the body (12) comprises a sleeve-shaped rear portion (28) which is screwed into a forward portion (29) receiving the second magnetic element (1) and which retains with one end (28*a*) the tank (R) within the said body.

8. An apparatus according to claim 3, wherein the body (12) comprises a sleeve-shaped rear portion (28) which is screwed into a forward portion (29) receiving the second magnetic element (1) and which retains with one end (28*a*) the tank (R) within the said body.

* * * * *